US008715009B2

(12) United States Patent
Wu et al.

(10) Patent No.: US 8,715,009 B2
(45) Date of Patent: May 6, 2014

(54) EDGE CONNECTOR

(75) Inventors: Leon Wu, Taoyuan (TW); Richard Chiu, Taoyuan (TW)

(73) Assignee: FCI, Guyancourt (FR)

( * ) Notice: Subject to any disclaimer, the term of this patent is extended or adjusted under 35 U.S.C. 154(b) by 691 days.

(21) Appl. No.: 12/309,094

(22) PCT Filed: Jul. 10, 2007

(86) PCT No.: PCT/EP2007/006113

§ 371 (c)(1),
(2), (4) Date: Oct. 15, 2009

(87) PCT Pub. No.: WO2008/006550

PCT Pub. Date: Jan. 17, 2008

(65) Prior Publication Data

US 2010/0062649 A1 Mar. 11, 2010

(30) Foreign Application Priority Data

Jul. 10, 2006 (TW) ..... 95125101 A

(51) Int. Cl.
*H01R 24/00* (2011.01)

(52) U.S. Cl.
USPC ..... 439/637

(58) Field of Classification Search
USPC ..... 439/271, 636, 637, 631
See application file for complete search history.

(56) References Cited

U.S. PATENT DOCUMENTS

| | | | | | |
|---|---|---|---|---|---|
| 3,474,387 | A | * | 10/1969 | Krum et al. | 439/260 |
| 3,594,699 | A | * | 7/1971 | Jayne et al. | 439/325 |
| 3,671,917 | A | * | 6/1972 | Ammon et al. | 439/62 |
| 3,868,166 | A | * | 2/1975 | Ammon | 439/634 |
| 4,262,981 | A | * | 4/1981 | Goodman | 439/62 |
| 4,586,772 | A | * | 5/1986 | Cobaugh et al. | 439/325 |
| 4,619,495 | A | | 10/1986 | Sochor | 339/176 |
| 4,781,612 | A | | 11/1988 | Thrush | 439/328 |
| 4,795,374 | A | * | 1/1989 | Rishworth et al. | 439/634 |
| 4,934,961 | A | * | 6/1990 | Piorunneck et al. | 439/637 |
| 4,996,766 | A | * | 3/1991 | Piorunneck et al. | 29/842 |
| 5,041,023 | A | * | 8/1991 | Lytle | 439/637 |
| 5,667,392 | A | * | 9/1997 | Kocher et al. | 439/79 |
| 5,801,421 | A | * | 9/1998 | Sher et al. | 257/355 |
| 5,848,920 | A | * | 12/1998 | Klein et al. | 439/885 |
| 6,036,548 | A | | 3/2000 | Braithwaite | 439/637 |
| 6,071,152 | A | * | 6/2000 | Achammer et al. | 439/733.1 |
| 6,160,716 | A | * | 12/2000 | Perino et al. | 361/785 |
| 7,351,091 | B1 | * | 4/2008 | Zhang | 439/405 |
| 7,896,661 | B2 | * | 3/2011 | Yao et al. | 439/83 |
| 7,976,345 | B2 | * | 7/2011 | Szczesny | 439/637 |

FOREIGN PATENT DOCUMENTS

GB 1 070 075 A 5/1967

* cited by examiner

*Primary Examiner* — Neil Abrams
*Assistant Examiner* — Travis Chambers
(74) *Attorney, Agent, or Firm* — Harrington & Smith

(57) ABSTRACT

An edge connector for transmitting signals at a high frequency, for example in a system environment with a frequency higher than 2.0 GHz or 3.0 GHz, is provided. The connector includes a housing and at least a first and a second conductors disposed in the housing. Each conductor has a contact portion and a terminal portion, and each contact portion form a contact surface. The at least first and second conductors are disposed in the housing in such a manner that, both the contact surfaces face a first direction, the terminal portion of the first conductor is offset from the contact portion of the first conductor along the first direction, and the terminal portion of the second conductor is offset from the contact portion of the second conductor along a second direction which is opposite to the first direction.

19 Claims, 7 Drawing Sheets

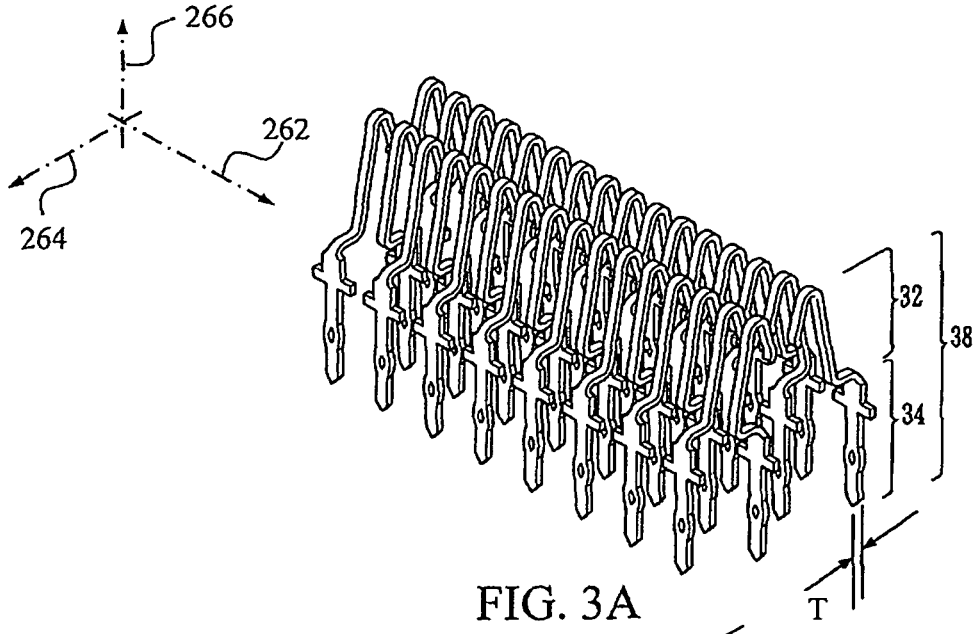
FIG. 3A
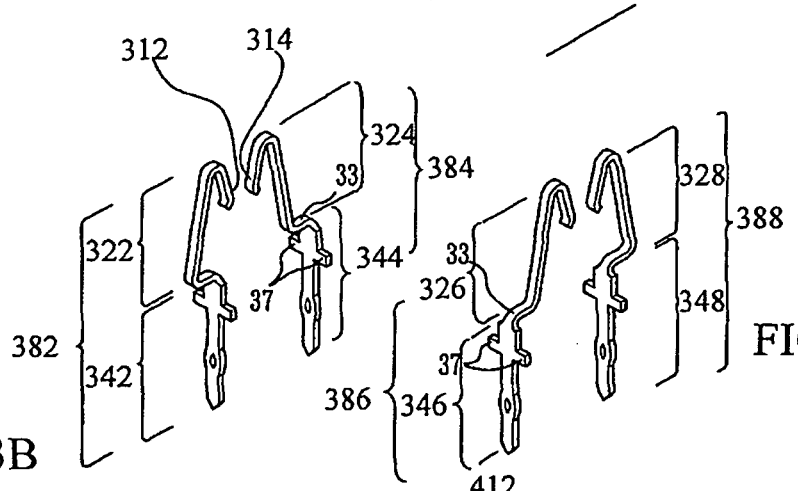
FIG. 3B
FIG. 3C
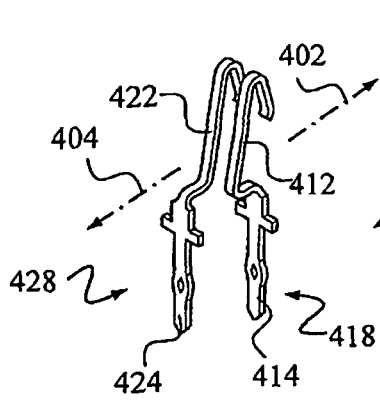
FIG. 3D
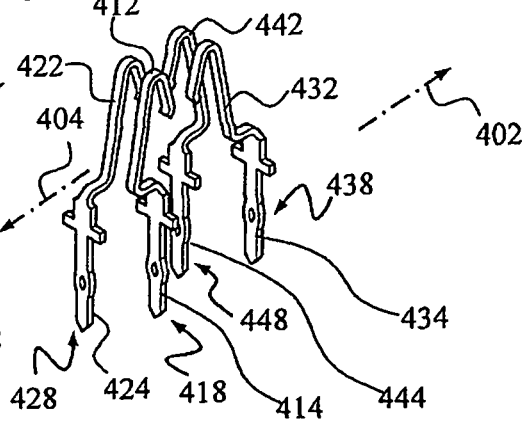
FIG. 3E

EDGE CONNECTOR

FIELD OF THE INVENTION

The present invention relates to an electrical connector, and more particularly to an edge connector for transmitting signals at a high frequency for example, higher than 400 MHz or even higher than 2.0 GHz.

BACKGROUND OF THE INVENTION

In a computer or telecommunication system, an interface connecting to the external is generally designed as a bus for transmitting various data. The hardware interface is fabricated to be an expandable slot, i.e., a so-called edge connector. The slot is attached to a motherboard. A modular daughter board, such as an interface card or memory card, can be inserted into the slot, so as form a connection interface. The edge connector generally connects a motherboard and a daughter board in the following manner. Through holes for connecting the connectors are formed on the motherboard. A conductive metal layer is plated to the inner surface and the periphery of the through holes, and the circuits to be connected to the bus on the motherboard are connected to the corresponding through holes. Pins of the edge connector pass through the through holes of the motherboard and are temporarily retained on the motherboard. The pins are then firmly retained on the motherboard by soldering or other processes, so as to achieve electrical connection with the motherboard.

The daughter board includes various electronic elements and circuit structures required for achieving the interface function, and "gold fingers," i.e., a row of conductive pads, in the shape of rectangle or ellipse, connected to the circuits of the daughter board, are fabricated on the end or edge portion of the daughter board for connecting to the edge connector. The end or edge portion with gold fingers of the daughter board is inserted into the slot of the edge connector. Two inner sides of the slot contain contact areas of conductors; the other ends of the conductors are pins of the connector to be soldered on the motherboard. The gold fingers contact the contact areas of the conductors of the connector correspondingly, so that the circuits of the motherboard and the daughter boards are communicated.

The electrical connector is mainly used for transmitting signals completely and correctly, and is a typical passive element. In recent years, the speed of central processing unit (CPU) for computers is improved continuously, from the earliest 33 MHz, 66 MHz, to Pentium III 500 MHz and to the latest Pentium IV 3.06 GHz. As such, the electronic signal transmission speeds of main board and computer peripherals must be increased accordingly, so as to match the processing speed of the CPU.

Signal transmission through a connector can be classified into two modes, namely single-ended signal and differential mode signal. The single-ended signal means that only one conductor is used when transmitting one signal between two electronic elements or devices that are connected. The transmission of a differential mode signal requires two matching conductors, so as to transmit the signals back and forth between two electronic elements or devices that are connected.

The differential mode signals transmitted on two conductors are two complementary signals, i.e., having the same amplitude but opposite polarities (with a phase difference of 180 degrees). In a high-speed transmission environment, a better electrical characteristic is obtained by differential mode signal transmission. The time sequence and response capability required by the system can be easily achieved, thereby the probability of the system's misjudging or missing part of the data can be reduced. Therefore, in practice, when an edge connector is used to connect various interface cards and memory modules to the motherboard, each pair of conductors (generally referred to as "contacts") on one side of the connector is mostly used to transmit signals under the differential mode.

Although better electrical characteristics of a connection system can be obtained by using differential mode signal transmission, the electrical characteristics of a pair of differential mode signals with opposite polarities is affected by the design factors of the connector, such as the material and shape of the conductor, the arrangements of the conductors in relation to each other, as well as the arrangement of the conductors with the insulative material. Particularly, as computers and communication apparatus are getting smaller, the structure of the electronic connector also becomes more and more impact, e.g. with the distance between the conductors of the connector greatly reduced, and the density of the pins increased. These changes, however, aggravates the problems related to signal transmission with high speed or high frequency, such as impedance, cross talk, propagation delay, attenuation, skew and rise time degradation. Therefore, obtaining desired performance of the system with a appropriate connectors has become a challenge to the industry.

SUMMARY OF THE INVENTION

A purpose of the present invention is to provide a connector for transmitting differential mode signals with a good electrical characteristic in an environment of high-density pins and high-speed transmission environment.

Another purpose of the present invention is to provide a connector with high density pins which can be press-fitted in an assembled state and that pin retraction or inappropriate bending can be greatly reduced when the terminals of the press-fit connector are pressed into the through holes on a motherboard.

In one embodiment, a connector for establishing electrical connection between a motherboard and a daughter board is provided. More particularly, an edge connector for transmitting signals at a high frequency, for example in a system environment with a frequency higher than 2.0 GHz or 3.0 GHz, is provided. The connector includes a housing and at least a first and a second conductors disposed in the housing. Each conductor has a contact portion and a terminal portion, while each contact portion form a contact surface. The at least first and second conductors are disposed in the housing in such a manner that, both the contact surfaces face a first direction, the terminal portion of the first conductor is offset from the contact portion of the first conductor along the first direction, and the terminal portion of the second conductor is offset from the contact portion of the second conductor along a second direction which is opposite to the first direction.

For a better understanding of the present invention and its purpose and preferred embodiments, further description accompanied by figures is provided in detail below.

BRIEF DESCRIPTION OF THE DRAWINGS

FIG. 3A is a perspective view showing the conductors of a connector of FIG. 1 with the housing removed;

FIGS. 3B-3E are perspective views showing the arrangements of part of the conductors of FIG. 1;

DETAILED DESCRIPTION OF PREFERRED EMBODIMENTS

Figure 1:
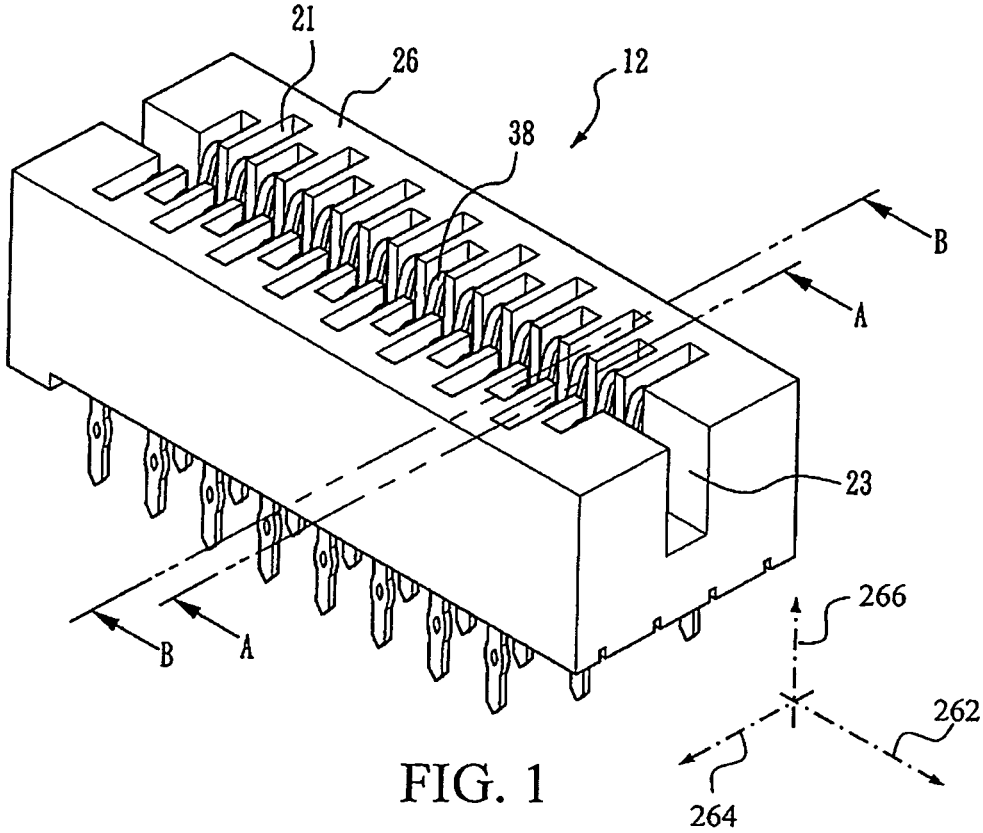
FIG. 1 is a perspective view of a connector according to one embodiment of the present invention.

Preferred embodiments of the present invention will be illustrated with reference to the accompanying drawings, and reference numerals in the drawings are used to indicate corresponding elements.

As shown in FIG. 1, a high speed connector 12 is generally of an elongated rectangular shape, and includes a housing 26 molded from electrically insulative material, with a plurality of compartments 21 formed therein and a long slot 23 in a central portion. The compartments 21 are located on two sides of the slot 23 and each compartment has a conductor 38 retained therein. For the purpose of illustration of the orientation of housing 26 and conductors 38, housing 26 defines a longitudinal or length direction 262, a lateral or width direction 264, and an elevation or height direction 266.

Figure 2A:
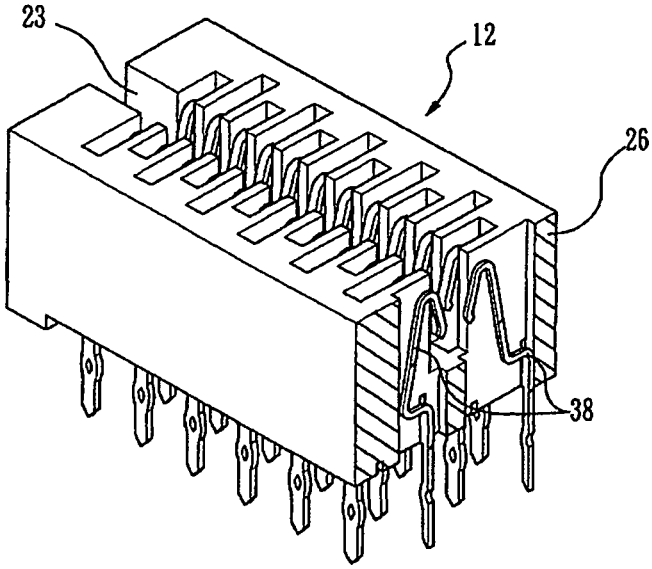
FIG. 2A is a perspective cross-sectional view of FIG. 1 taken along line A-A.
Figure 2B:
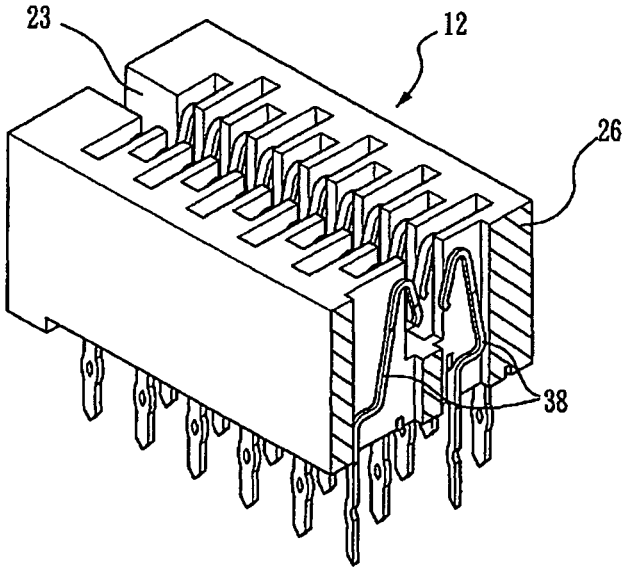
FIG. 2B is a perspective cross-sectional view of FIG. 1 taken along line B-B.

FIG. 2A is a perspective cross-sectional view of a connector shown in FIG. 1, taken along line A-A in FIG. 1, and FIG. 2B is a perspective cross-sectional view taken along line B-B in FIG. 1. The section planes taken along lines A-A and B-B as shown in FIG. 2A and FIG. 2B are the cross-sections of two adjacent compartments along a direction of the length of the housing 26, in which a conductor 38 is disposed in each of the two opposite compartments located on two sides of the slot 23 of the housing 26.

FIGS. 3A-3D show the configuration and arrangement of the conductors 38. FIG. 3A shows the configuration and arrangement of the conductors 38 of FIG. 1 with the housing 26 removed for better illustration. Each of the conductors 38 is formed of an elongated conductive material, with a same lateral dimension or same thickness T along the length of conductor body, and has a contact portion 32 and a terminal portion 34. A bending area or center portion is formed between the contact portion 32 and the terminal portion 34, i.e., the terminal portion 34 of the conductor 38 is not in alignment with contact point or contact surface 31 along height direction. Instead conductor 38 is deformed to form a bending area 33 between contact portion 32 and terminal portion 34, such that terminal portion 34 is offset parallel to, i.e. along the same or opposite direction of, the lateral direction, and then extends downward along a direction opposite to the elevation direction.

FIG. 3B further shows a configuration of a first and second conductors 382 and 384, arranged with respective contact portions 324 and 322 opposite to each other in the section plane of FIG. 2A. The terminal portion 344 of the conductor 384 on the right side shifts or offset laterally towards the back of the contact portion 324, and the terminal portion 342 of the conductor 382 on the left side shifts or offset laterally towards the front of the contact portion 322.

FIG. 3C shows a configuration of a first and second conductors 386 and 388 arranged opposite to each other in the section plane of FIG. 2B. The shifting manner of the terminal portions of the conductors in FIG. 2B is the opposite of that in FIG. 2A. That is to say, in FIG. 3C, the terminal portion 348 of the conductor 388 on the right side shifts or offset laterally towards the front of the contact portion 328, and the terminal portion 346 of the conductor 386 on the left side shifts towards the back of the contact portion 326. Therefore, the terminal portions of the conductors in the two compartments 21 disposed on opposite sides of the slot 23 shift or offset laterally in opposite directions, and the terminal portions of the conductors in the two compartments 21 adjacent to each other along the length direction of the connector 12 also shift or offset laterally in opposite directions.

FIG. 3D shows a configuration of a first conductor 418 and a second conductor 428 arranged in a side-by-side manner i.e. with contact surfaces facing the same direction, which is a first direction 402. Terminal portion 414 of first conductor 418 is offset from contact portion 412 of first conductor 418 along same first direction 402. Terminal portion 424 of second conductor 428 is offset from contact portion 422 of second conductor 428 along a second direction 404 which is opposite to first direction 402.

FIG. 3E shows a third conductor 438 positioned facing or opposite to first conductor 418, and a fourth conductor 448 positioned facing or opposite to third conductor 438. Terminal portion 434 of third conductor 438 is offset from contact portion 432 of the third conductor 438 along the first direction 402, and terminal portion 444 of fourth conductor 448 is offset from contact portion 442 of fourth conductor 448 along the second direction.

Figure 4:
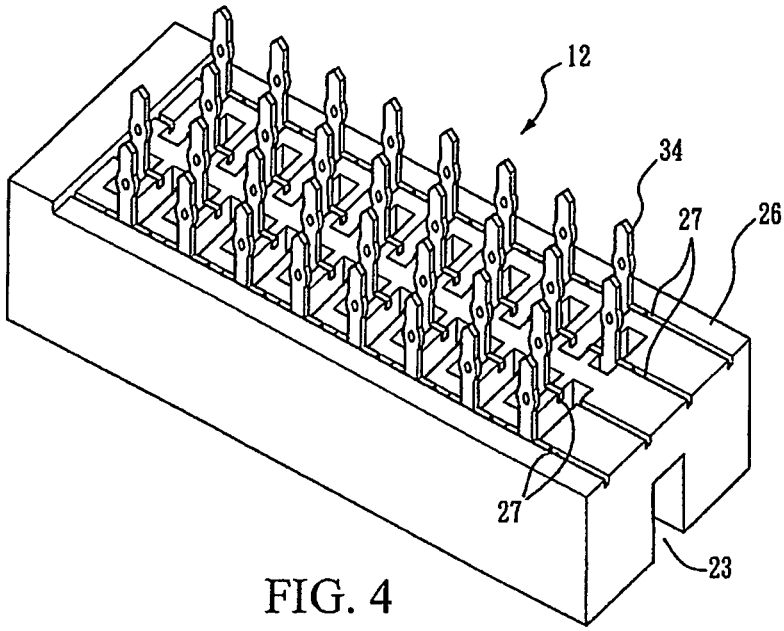
FIG. 4 is a perspective view illustrating the bottom of the connector of FIG. 1.

It can be clearly seen in FIG. 3E that, the terminal portions of the four conductors are shifted and staggered. Therefore, after the conductors are assembled with the housing 26, all the portions of the terminal portions exposed outside the bottom of the connector 12 are arranged in the pattern of staggered diamond checks as shown in FIG. 4. The diamond check arrangement enables a maximum connection points to be obtained on the smallest component disposal area on the arrangement of the through holes on the motherboard connected with the terminal portions of the connector 12. When connection is made by passing the pins (terminals) of the connector through the through holes on the motherboard, the sizes of the pins and the through holes are limited. If the pins are too thin for matching small through holes, the strength of the pins may be insufficient, the signal transmission quality may also be poor. Besides, when connected to the motherboard by means of soldering or press-fit process, the reliability of the contacts may also be low. Therefore, sufficiently strong pins are preferred to match through holes with appropriate sizes. In order to maintain enough distance between through holes, the surface area of the motherboard occupied by the overall through hole arrangement with the pins arranged in common square array is greater than the area occupied by the diamond check arrangement. Therefore, with the trend of high density and miniaturizing substrate assembly, it is advantageous to adopt the shape of staggered and shifted terminal portions.

Figure 5:
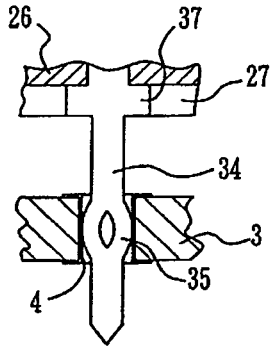
FIG. 5 is a partial cross-sectional view showing a terminal portion of a conductor of a connector after being press-fitted in a through hole on a motherboard, according to one embodiment of the present invention.

An embodiment of the present invention illustrates that the connector 12 is mounted on the motherboard in a manner other than soldering. As shown in FIG. 5, a press-fit structure 35 with slight elasticity is formed in a suitable position on the terminal portion 34, for interference fitting with the through hole on the motherboard. The press-fit structure 35 forms a needle-eye shape, and the material of the periphery of the needle-eye interferes with the periphery of the through hole on the motherboard. Because of the elasticity of the needle-eye shape and the inherent elasticity of the material of the motherboard, the protrusion of the press-fit structure 35 can closely engage the conductive pad 4 plated onto the through hole on the motherboard. The shape and size of the press-fit structure 35 are configured such that it will not thoroughly damage the conductive pad 4 of the through hole (as shown in FIG. 5). The conductive pad 4 is connected to the circuits inside the motherboard, so the connector 12 is electrically connected to the circuits of the motherboard. As described above, the press-fit manner can achieve better and reliable electrical characteristics than soldering.

Figure 6:
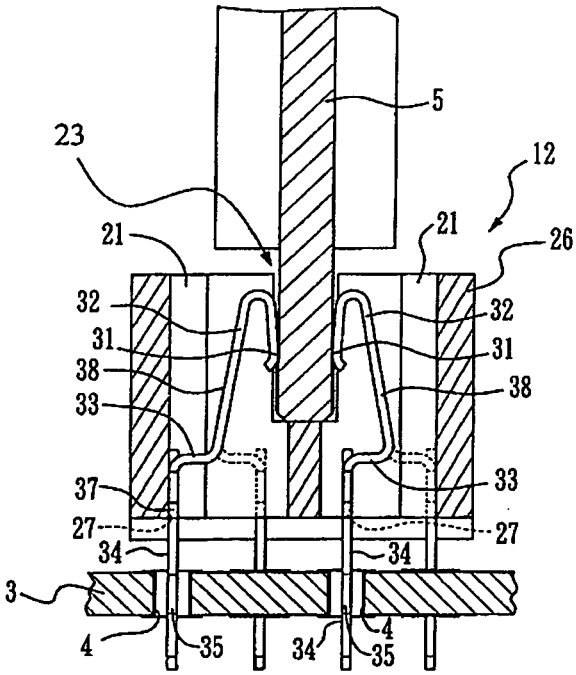
FIG. 6 is a cross-sectional view of a connector according to one embodiment of the present invention after it is assembled with a motherboard and a daughter board.

When using the above mentioned press-fit manner to press-fit the assembled connector onto the motherboard, a sufficient interference retaining force between the terminal portion 34 of the conductor 38 and the through hole on the motherboard is necessary, so the force for press-fitting the terminal portion 34 into the through hole must be sufficiently large. Accordingly, the generated counter force has a tendency to deform the terminal portion 34 of the conductor 38, or to disengage the conductor 38 and makes it move upward out of the housing 26. In order to solve this problem, protrusion 37 towards one or two sides is formed on the upper portion of the terminal portion of the conductor 38, as shown in FIG. 3B, and a recess 27 for receiving the protrusion 37 is formed in the corresponding position of the compartment 21 of the housing 26, as shown in FIGS. 4, 5 and 6. An upper surface of the protrusion 37 abuts against a lower surface of housing 26 in the recess 27. In this way, when receiving the counter force during the press-fit operation, conductors 38 will not be pushed out of the housing 26, since the lower surface of housing 26 in the recess 27 prevents the protrusion 37 of the conductor 38 from moving upward. Moreover, the width of the protrusion 37 can be slightly greater than that of recess 27, so as to interference-fit the recess 27. The conductor 38 can then be retained in a fixed position in the housing 26 and not easily moved or shaken.

As shown in FIG. 6, in one embodiment of the present invention, a gold finger end in the lower part of a daughter board 5 is inserted in slot 23 of connector 12. Said daughter board carries memory chips or other interface elements. The terminal portions 34 of the connector 12 are inserted into and connected with the through holes 4 on motherboard 3 through press-fit structures 35. The contact portion 32 of the conductor 38 is a flexible structure, and is shaped by bending a flat thin plate which has a same thickness or lateral dimension. When the daughter board 5 is inserted in the slot 23, an elastic deformation of the contact portion 32 occurs. Electrical connection is therefore achieved by contacting a contact point 31 with the gold finger of the daughter board 5.

As described above, the connector 12 can be electrically connected with the motherboard by the press-fit structure 35, and thus electrical signals between the motherboard 3 and the daughter board 5 can be transmitted back and forth through the contact point 31 of the conductor 38 and the press-fit structure 35.

In order to obtain the electrical characteristics required for high-speed transmission, particularly when the signal frequency is higher than 2.0 GHz or even 3.0 GHz, a connector according to the present embodiment uses the press-fit assembly process to connect the press-fit structure 35 with the motherboard. This improves the quality and reliability of signal transmission. Since the differential mode signals are signals of the same amplitude but opposite phases, which are transmitted by two matching conductors, the lengths of the signal transmission paths formed by the adjacent conductors 38 of the connector along the length direction of the slot 23 are preferably the same in each pair. Therefore, the lengths of the adjacent conductors 38 in each pair extending from the contact point 31 to the press-fit structure 35 may be the same, and the shapes of signal transmitting sections extending from the lower part of the contact portion 32 connecting with the bent portion 33 to the beginning of the terminal portions 34 may be symmetrical.

In order to have better electrical characteristics required for high speed transmission, the bent portion 33 of the conductor, or preferably including a portion of terminal portion 34 under the bent portion 33, are preferably located in the compartment 21 of the housing 26, instead of being exposed outside the housing 26. Since the dielectric constant of the insulative material of the housing 26 is greater than that of air, the housing 26 can provide same shield effect to the entire signal transmission path of the conductor 38, thereby attenuating outward signal radiation. As a result, the signals along the signal transmission path have high intensity, and interference from the conductor to other surrounding conductors may be reduced and therefore, cross talk can be reduced. As to the pairs of conductors 38 disposed on two opposite sides of the slot 23 and facing to each other, or those conductors used for grounding, since they are not differential mode signal transmitting pairs, it is not necessary that their signal transmission paths are to be identical or symmetrical.

Figure 7A:
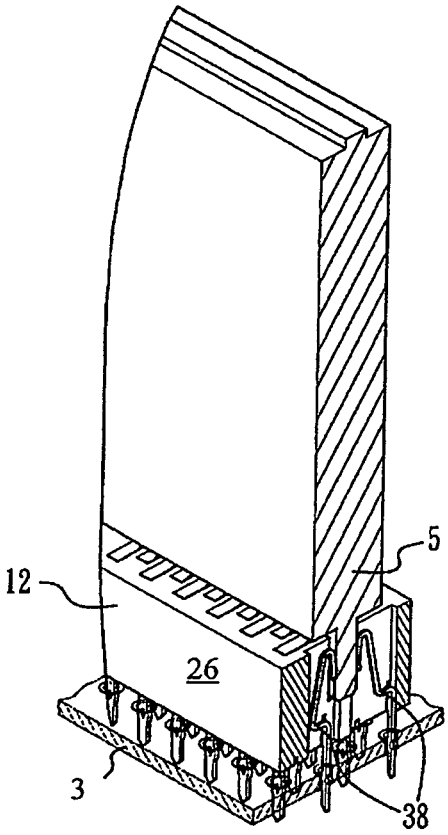
FIGS. 7A-7B are perspective cross-sectional views of a connector according to one embodiment of the present invention, after it is assembled with a motherboard and a daughter board.
Figure 7B:
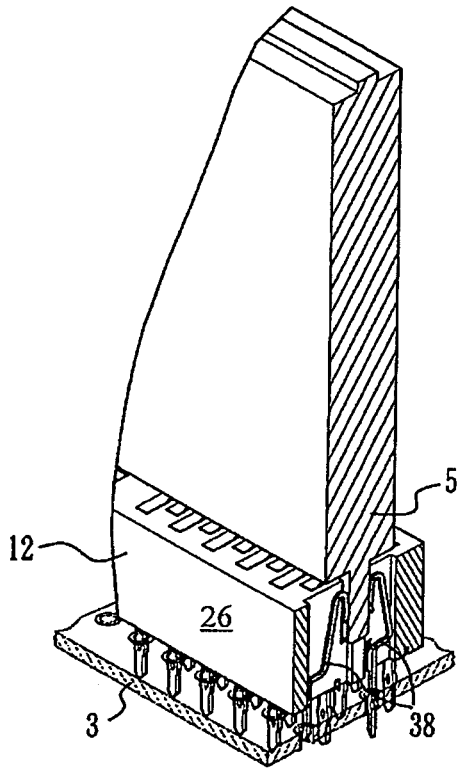

FIG. 7A and FIG. 7B are perspective cross-sectional views showing a connector according to one embodiment of the present invention, when being assembled to a mother board and received a daughter card. In this embodiment, the transverse sections are taken from two adjacent compartments in the housing 26.

Figure 8:
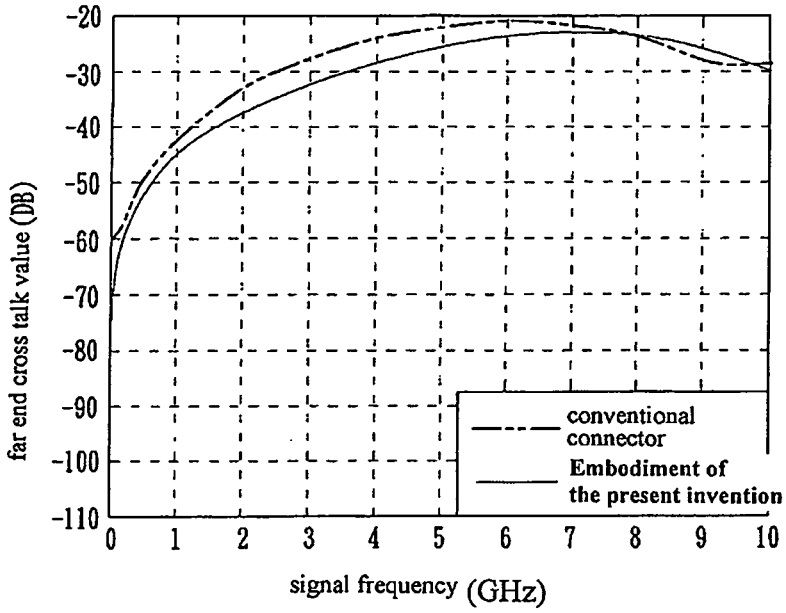
FIG. 8 and FIG. 9 are schematic charts showing far end cross talk test results at different signal frequencies of a connector according to one embodiment of the present invention.
Figure 9:
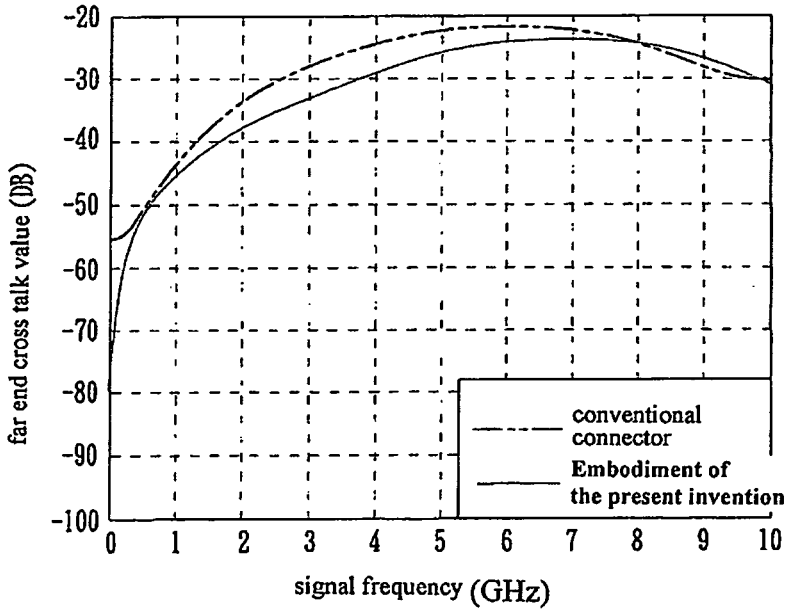

FIG. 8 and FIG. 9 show the test results of a far end cross talk test when a connector according to an embodiment of the present invention is used in high-speed signal transmission. When the frequency is lower than 2.5 GHz, the far end cross talk value of a connector according to an embodiment of the present invention will not exceed −33 dB. When the frequency increases up to 3.5 GHz, the far end cross talk value of the connector using the present invention will not exceed −29 dB. As shown, this performance is better than that of a conventional connector. Moreover, a connector according to an embodiment of the present invention also has smaller differential insertion loss and smaller differential return loss during high speed transmission.

Figure 10A:
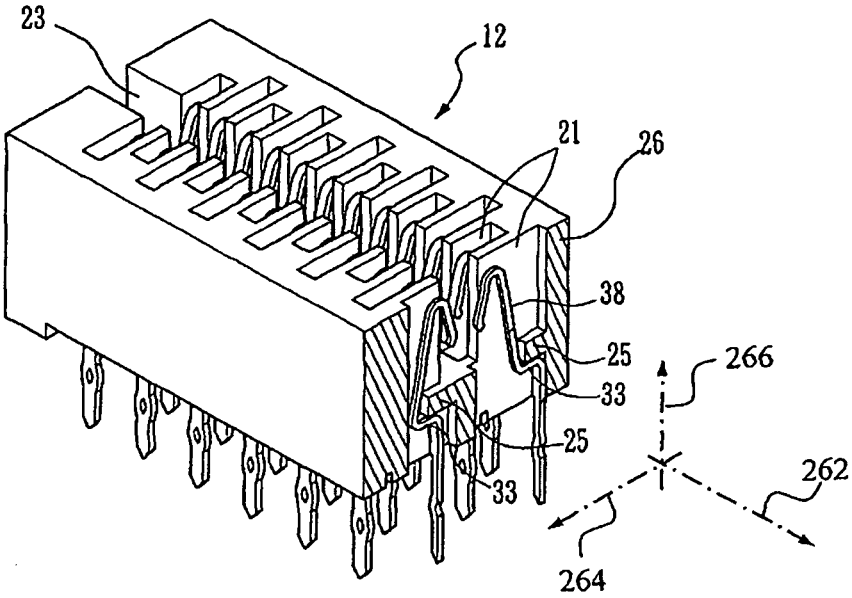
FIG. 10A and FIG. 10B are perspective cross-sectional views of a connector according to another embodiment of the present invention.
Figure 10B:
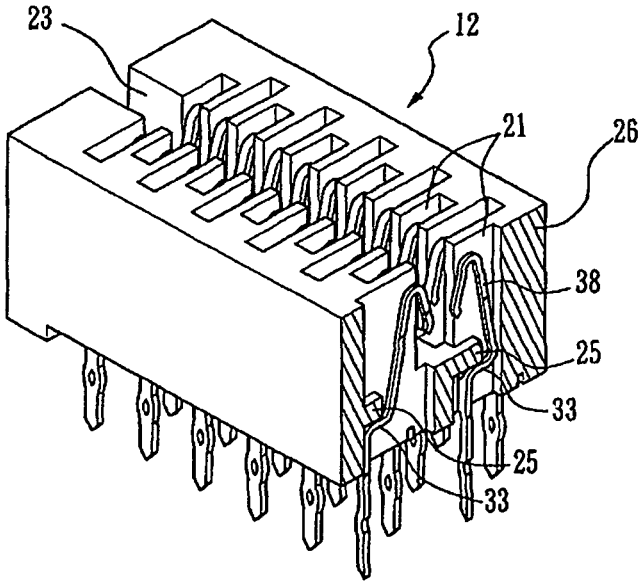

In another embodiment as shown in FIG. 10A and FIG. 10B, conductor 38 has a bent portion 33 which is extended parallel to lateral direction 264. Two sidewalls inside the compartment 21 of the housing 26 protrude to form stopper structure 25. Said stopper structure 25 abuts against bent portion 33. Alternatively, stopper structure 25 may not be an integral part of the sidewall, but a separate block which is inserted and then fixed in the correct position in the housing, so as to form the structure abutting on the bent portion 33. Such a stopper structure can block the conductor 38, so as to prevent the conductor 38 from being moved upward to be exposed out of the housing 26 by the counter force during press-fitting process. On advantage of this embodiment is that, as the separate block is formed independent from the housing, the separate block can be formed of a resilient material. When act against the bent portion, the resilient block can service as a buffer to absorb or reduce the impact added onto the conductors, hence is helpful to protect the conductors from being damaged during press-fit process.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. An edge connector comprising:

a housing formed therein with a plurality of compartments for receiving conductors; and at least one pair of conductors disposed in said compartments adjacent to each other along one side of said housing, said conductors having a contact portion, a terminal portion and a bent portion between the contact portion and the terminal portion, said bent portion of each pair of conductors being bent to opposite directions to form a shape symmetrical to each other, and at least the bent portions of the terminal portions of all the conductors being housed by the housing, where the terminal portion is located entirely below the bent portion, where the contact portion comprises an inverting bend proximate a top of the housing and a contact point extending down from the inverting bend, and where the edge connector is configured for transmitting signals in a frequency higher than 2.0 GHz.

2. The edge connector according to claim 1, wherein said housing is molded from electrically insulative material.

3. The edge connector according to claim 1, wherein the bent portion of said terminal portion forms a shoulder which is substantially horizontal and slightly wider than the contact portion, the shoulder being buried in said housing and abutting against a stopper in said housing.

4. The edge connector according to claim 1, wherein said terminal portion includes a press-fit structure.

5. The edge connector according to claim 4, wherein said press-fit structure forms a needle-eye shape.

6. The edge connector according to claim 1, wherein the lengths of a part of the conductors in pair of all conductors extending from the contact point of said contact portion to the area of said terminal portion in connection with electrical circuits printed on a board are equal.

7. The edge connector according to claim 6, wherein said part of the conductors in pair having equal lengths extending from the contact point of said contact portion to the area of said terminal portion in connection with electrical circuits printed on a board are used for transmitting differential signal.

8. An edge connector, comprising:

a housing formed therein with a plurality of compartments arranged in two rows along the opposite sides thereof for receiving conductors;

at least one slot for receiving an article to be connected defined by an openings) formed between the two rows of said compartments;

at least one pair of conductors disposed in said compartments adjacent to each other along one side of said housing, said conductors having a contact portion, a terminal portion and a bent portion located between the contact portion and the terminal portion, said bent portions of each pair of conductors being bent to opposite directions to form a shape symmetrical to each other, and at least the bent portions of the terminal portions of all the conductors being housed by the housing, where the terminal portion is located entirely below the bent portion, and where the contact portion comprises a reversing bend proximate a top of the housing and a contact point extending down from the reversing bend.

9. The edge connector according to claim 8, wherein said housing is molded from electrically insulative material.

10. The edge connector according to claim 8, wherein the lengths of the conductors in one side extending from the contact point of said contact portion to the area of said terminal portion in connection with electrical circuits printed on a board are equal.

11. The edge connector according to claim 8, wherein the bent portion of said terminal portion forms a shoulder which is substantially horizontal and slightly wider than the contact portion, the shoulder being buried in said housing and abutting against a stopper in said housing.

12. The edge connector according to claim 8, wherein said terminal portion includes a press-fit structure.

13. The edge connector according to claim 12, wherein said press-fit structure forms a needle-eye shape.

14. An edge connector comprising:

a housing formed therein with a plurality of compartments arranged in two rows along the opposite sides thereof for receiving conductors;

at least one slot for receiving an article to be connected defined by an opening(s) formed between the two rows of said compartments; and at least one pair of conductors disposed in said compartments adjacent to each other along one side of said housing, said conductors having a contact portion, a terminal portion and a bent portion between the contact portion and the terminal portion, said bent portions of each pair of conductors being bent to opposite directions to form a shape symmetrical to each other, and at least the bent portions of the terminal portions of all the conductors being housed by the housing, where the edge connector is configured for transmitting signals in a frequency higher than 2.0 GHz, where the terminal portion is located entirely below the bent portion, and where the contact portion comprises a reversing bend proximate a top of the housing and a contact point extending down from the reversing bend.

15. The edge connector according to claim 14, wherein said housing is molded from electrically insulative material.

16. The edge connector according to claim 14, wherein the lengths of the conductors in one side extending from the contact point of said contact portion to the area of said terminal portion in connection with electrical circuits printed on a board are equal.

17. The edge connector according to claim 14, wherein the bent portion of said terminal portion forms a shoulder which is substantially horizontal and slightly wider than the contact portion, the shoulder being buried in said housing and abutting against a stopper in said housing.

18. The edge connector according to claim 14, wherein said terminal portion includes a press-fit structure.

19. The edge connector according to claim 18, wherein said press-fit structure forms a needle-eye shape.

* * * * *